US006149234A

United States Patent [19]

Daniels

[11] Patent Number: 6,149,234

[45] Date of Patent: Nov. 21, 2000

[54] BEACH CHAIR TOWEL RETAINER SYSTEM

[76] Inventor: Dorothy M. Daniels, 19108 St. Laurent Dr., Lutz, Fla. 33549

[21] Appl. No.: 08/856,918

[22] Filed: May 15, 1997

Related U.S. Application Data

[63] Continuation of application No. 08/623,057, Mar. 28, 1996, abandoned, which is a continuation of application No. 08/394,181, Feb. 24, 1995, abandoned.

[51] Int. Cl.[7] ..... A47C 31/00

[52] U.S. Cl. ..... 297/229; 5/498; 5/496; D6/611; 297/188.06

[58] Field of Search ..... 297/229, 188.01, 297/188.06, 188.2; 5/496, 498, 656; D6/601, 610, 611, 606

[56] References Cited

U.S. PATENT DOCUMENTS

| | | | |
|---|---|---|---|
| D. 247,312 | 2/1978 | Zeiss | D6/601 X |
| D. 250,835 | 1/1979 | Grube | D6/502 X |
| D. 282,407 | 2/1986 | Braun et al. | D6/601 X |
| D. 312,019 | 11/1990 | Woods et al. | D6/601 |
| D. 331,521 | 12/1992 | Kelldorf | D6/611 |
| D. 338,587 | 8/1993 | Harnish | D6/601 |
| D. 359,192 | 6/1995 | Franklin, III | D6/606 |
| 1,765,965 | 6/1930 | Cohen | 2/321 X |
| 2,188,576 | 1/1940 | Mulloy | 5/498 |
| 2,239,017 | 4/1941 | Roberts | 5/498 |
| 2,700,778 | 2/1955 | Syracuse | 5/496 |
| 2,705,331 | 4/1955 | Cone | 5/498 X |
| 3,479,085 | 11/1969 | Weinstein | 297/188.06 X |
| 4,131,313 | 12/1978 | Jacobs | 297/188.2 |
| 4,466,659 | 8/1984 | Carpentier et al. | 297/188.06 |
| 4,517,685 | 5/1985 | Lesley | 2/DIG. 11 X |
| 4,536,028 | 8/1985 | Jones et al. | 297/229 X |
| 4,553,785 | 11/1985 | Duke, Jr. et al. | 297/188.2 X |
| 4,589,149 | 5/1986 | Bassi | D6/611 X |
| 4,725,094 | 2/1988 | Greer | 297/188.06 X |
| 4,863,003 | 9/1989 | Carter | 297/188.01 X |
| 4,877,288 | 10/1989 | Lee | 297/229 |
| 4,884,305 | 12/1989 | Blackman | 5/496 |
| 4,910,804 | 3/1990 | Lidgren | 2/DIG. 11 X |
| 4,924,543 | 5/1990 | Hoss et al. | 5/496 X |
| 4,934,540 | 6/1990 | Novak | 211/124 |
| 5,275,463 | 1/1994 | Rocha | 297/188.01 X |
| 5,345,627 | 9/1994 | Cammarata | 5/419 |
| 5,503,456 | 4/1996 | Rossini | 297/397 |
| 5,584,456 | 12/1996 | Stephens | 248/316.5 X |

FOREIGN PATENT DOCUMENTS

| | | | |
|---|---|---|---|
| 1111821 | 11/1955 | France | 297/229 |
| 639020 | 5/1962 | Italy | 5/498 |

*Primary Examiner*—Peter M. Cuomo
*Assistant Examiner*—David E. Allred
*Attorney, Agent, or Firm*—S. C. Yuter, J.S.D.

[57] ABSTRACT

A beach chair towel retaining system is disclosed comprising a beach towel for covering a beach chair. An upper stretchable band resiliently surrounds both the upper portion of the towel and the upper portion of the beach chair and retains the upper portion of the towel on the surface of the upper portion of the beach chair. A lower stretchable band resiliently surrounds both the lower portion of the towel and the lower portion of the beach chair and retains the lower portion of the towel on the surface of the lower portion of the beach chair. Each of the upper and lower stretchable bands comprises a bunchable towel material encasing an elastic material. A saddle bag comprising a strip with a pocket, for item storage, at each end rests on top of the intermediate portion of the towel, with one of the pockets hanging on one side of the intermediate portion of the beach chair and the other of the pockets hanging on the other side to retain the intermediate portion of the towel on the intermediate portion of the beach chair. A pillow and a pocket are detachably attached to the outer surface of the upper stretchable band.

20 Claims, 3 Drawing Sheets

FIG.1
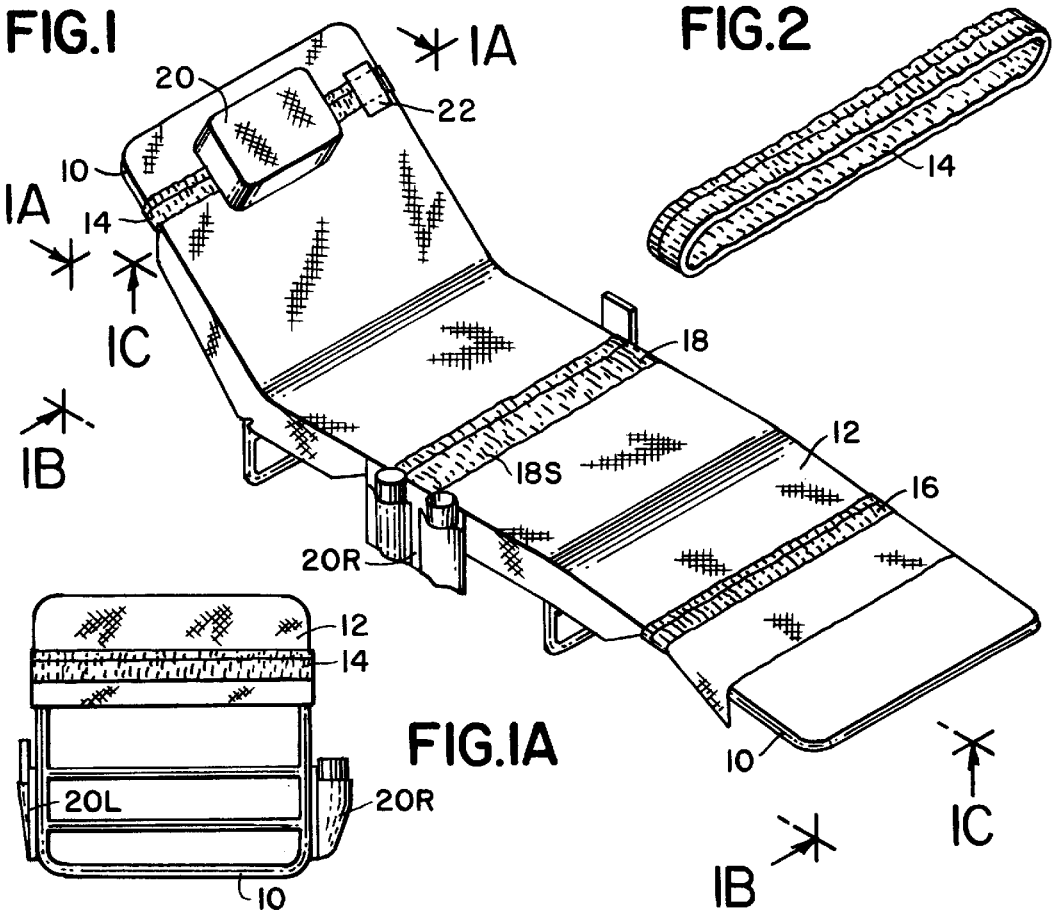
FIG.2
FIG.1A
FIG.1B
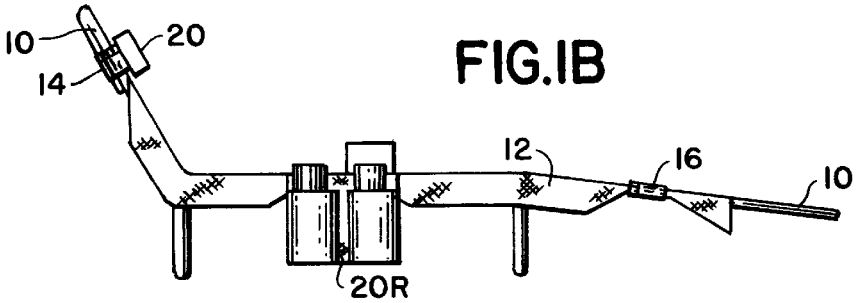
FIG.1C
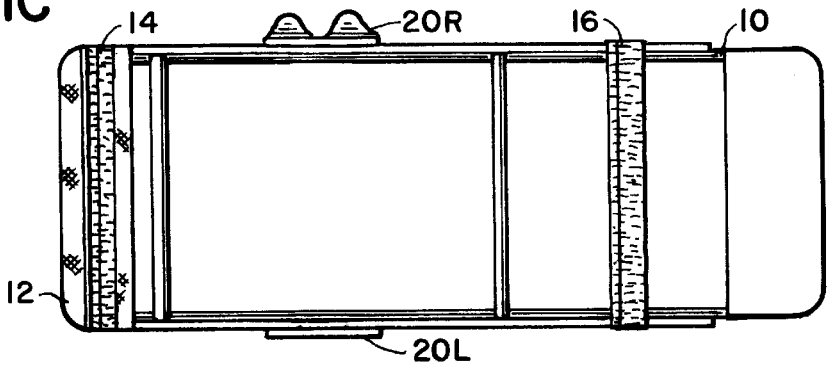

FIG.4A
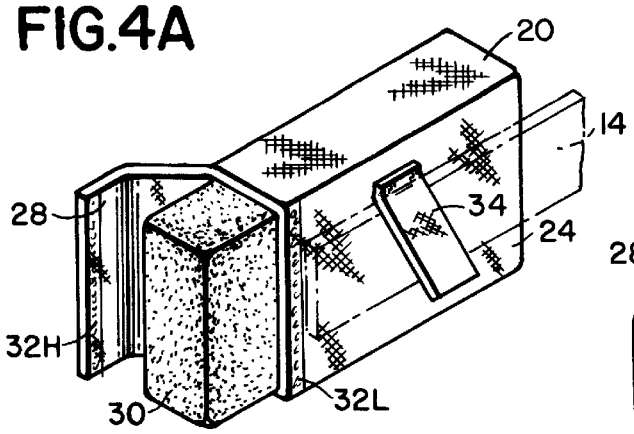
FIG.4B
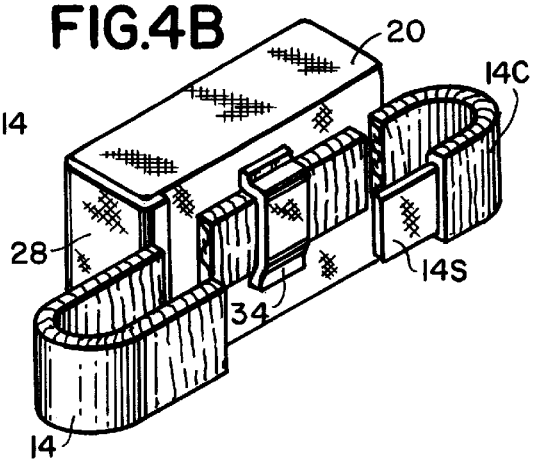
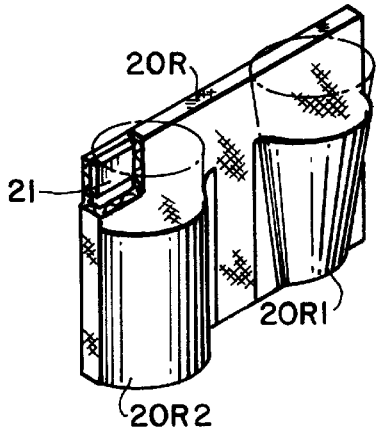
FIG.5B
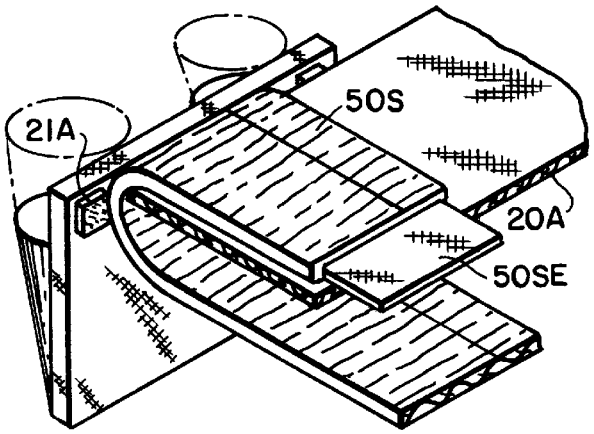
FIG.6
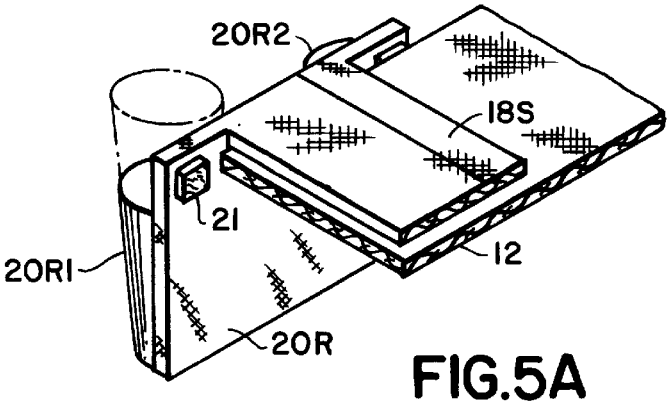
FIG.5A

BEACH CHAIR TOWEL RETAINER SYSTEM

This application is a continuation of application Ser. No. 08/623,057 filed Mar. 28, 1996 (now abandoned), which was a continuation of application Ser. No. 08/394,181 filed Feb. 24, 1995, (now abandoned).

BACKGROUND OF THE INVENTION

1. Field of the Invention

This invention relates to beach and pool chairs and chaises and more particularly to a system for retaining a towel covering a beach or pool chair or chaise from being displaced by the wind or the chair occupant.

2. Description of the Related Art

Beach and pool lounge chairs and chaises (herein jointly "beach chairs") used on beaches, adjacent swimming pools and on lawns are often covered by beach towels to provide a more comfortable environment in which to relax, avoid the tacky feeling of plastic and the more harsh feeling of wood, and to absorb any perspiration or dripping water. When the beach chair is not occupied, a gust of wind can blow the beach towel from the chair, or crumple it on the chair, so that it has to be realigned with the top surface of the chair, which can be annoying. Also, loose towels can become easily disarranged in use by the chair occupant and by gravity, and can become dirty by falling off the chair.

Clips have been used to keep the towel on the chair as well as covers which fit over the chair.

There is a need for an improved system for retaining a beach towel on an unoccupied beach chair. There is also a need for a pillow to make the chair occupant more comfortable, as well as places for storing audio cassettes, drinks, suntan lotion, reading materials, eye glasses, keys and other items which are useful to the chair occupant.

A preliminary search of the beach chair towel retainer system invention disclosed the following seven U.S. patents:

U.S. Pat. No. 3,143,747 entitled Bedclothes Clamp, FIGS. 3 and 4, shows a strap for securing a blanket to a bed to prevent a baby's head from slipping under the blanket.

U.S. Pat. No. 4,536,028 entitled Fitted Sheet for Lounge Chair, FIGS. 1–4, shows a fitted sheet for a lounge chair.

U.S. Pat. No. 4,725,094 entitled Expandable Terry Cloth Sand or Lawn Chair Cover Having Integrally Formed Pockets shows a terry cloth with pockets for beach chairs.

U.S. Pat. No. 4,844,540 entitled Combination Beach Towel and Chair Cover shows a beach towel with attached straps in order to function as a chair cover.

U.S. Pat. No. 4,877,288 entitled Lounge Chair Cover shows a lounge chair cover with various pockets including a pillow pocket.

U.S. Pat. No. 5,275,463 entitled Cover for Lounge Chair shows the use of Velcro fasteners for enclosing pillow and flap pockets of a unitary terry cloth beach chair cover.

U.S. Pat. No. 5,345,627 entitled Towel With Releasably Attached Pillow shows a beach pillow Velcro fastener attached directly to a towel with matching Velcro fastener strips.

None of these patents, either alone or in obvious combination, fully satisfies the needs detailed above or discloses the invention as claimed below.

BRIEF SUMMARY OF THE INVENTION

An object of the invention is to provide an improved beach chair towel retainer system for retaining a beach towel on an unocuppied beach chair from being displaced by the wind or by the chair occupant.

Another object of the invention is to provide a beach chair towel retainer system with an easily removable pillow for making a chair occupant more comfortable.

A further object of the invention is to provide a beach chair towel retainer system which conveniently can store drinks and other items useful for a beach chair occupant.

A still further object of the invention is to provide a chair towel retainer system which is relatively inexpensive to manufacture and easy to use.

Briefly, in accordance with the invention, a beach chair towel retaining system is provided for a beach chair having an upper portion for supporting the upper body of a chair occupant, an intermediate portion for supporting the intermediate body of the chair occupant and a lower portion for supporting the legs of the chair occupant comprising a beach towel having an upper portion for covering the upper portion of the beach chair, an intermediate portion for covering the intermediate portion of the beach chair and a lower portion for covering the lower portion of the beach chair. An upper stretchable band resiliently surrounds both the upper portion of the beach towel and the upper portion of the beach chair and retains the upper portion of the beach towel on the surface of the upper portion of the beach chair. A lower stretchable band resiliently surrounds both the lower portion of the beach towel and the lower portion of the beach chair and retains the lower portion of the beach towel on the surface of the lower portion of the beach chair. Each of the upper and lower stretchable bands preferably comprises a bunchable towel material encasing an elastic material.

A feature of the invention is a saddle bag comprising a strip with a pocket at each end, the strip being adapted to rest on top of the intermediate portion of the beach towel, with one of the pockets hanging on one side of the intermediate portion of the beach chair and the other of the pockets hanging on the other side of the intermediate portion of the beach chair, to retain the intermediate portion of the beach towel on the intermediate portion of the beach chair. The saddle bag preferably comprises a towel material. Items which can be held in the pockets include a canned or bottled beverage, glasses, keys, sun tan lotion and reading material.

Another feature of the invention is a pillow adapted to be detachably attached to the outer surface of the upper stretchable band. The pillow preferably comprises a towel material encasing a compressible material.

A further feature of the invention is the use of terry cloth as the towel material to provides the loops for Velcro-hook fastener attachments (which normally attach hooks on one fastener to loops on the other fastener). For example, one or more pockets may be Velcro-hook attached to the loops of terry cloth towel material of the upper stretchable band to hold a small radio or cassette player, headphones or eye glasses.

In a preferred embodiment of the invention the beach towel has a predetermined ornamental design and each of the towel material of the upper and lower stretchable bands, the saddle bag and the pillow has the same or a coordinated ornamental design corresponding with the predetermined ornamental design of the towel. Or the invention can be used with any towel design.

In an alternative feature of the invention the upper portion of the beach towel has an attached longitudinal loop adjacent each side adapted to receive and retain the upper stretchable band. Each of the attached longitudinal loops has one end permanently attached to the beach towel and the other end detachably attached to the beach towel.

In another aspect of the invention the beach chair has a mattress and the saddle bag strip comprises a stretchable band for resiliently surrounding both the intermediate portion of the beach towel and the mattress.

An advantage of the invention is that it can enhance the sale of beach towels when sold with matching design stretchable bands, saddle bags and pockets. Or the stretchable bands, saddle bags and pockets can be sold separately.

Another advantage of the invention is that it can be made from any fabric, such as canvas, nylon and cotton, as well as terry cloth.

A further advantage of the invention is that the beach towel can be separately laundered so that fewer launderings of the stretchable bands are required and thus their elasticity lasts longer.

BRIEF DESCRIPTION OF THE DRAWING

Other objects, features and advantages of the invention will be apparent from the following Descriptions of the Preferred and Alternative Embodiments taken together with the accompanying sheets of drawing in which:

FIG. 1 is a perspective view of a beach chair covered by a beach towel held in place by upper and lower stretchable bands and an intermediate saddle bag, and also showing a pillow and cassette-holding pocket detachably attached to the upper stretchable band, all in accordance with the preferred embodiment of the invention.

FIG. 1A is a back view of the upper portion of the beach chair of FIG. 1 taken along the lines 1A—1A in FIG. 1.

FIG. 1B is a side view of the beach chair of FIG. 1 taken along the lines 1B—1B in FIG. 1.

FIG. 1C is a bottom view of the beach chair of FIG. 1 taken along the lines 1C—1C in FIG. 1.

FIG. 2 a perspective view of one of the stretchable bands shown in FIG. 1.

FIG. 4A (sheet 3) is a perspective view of the detachably attached pillow shown in FIGS. 1 and 2, showing an outer pillow case with a coverable opening for inserting a compressible pillow, and a loop having a detachably attachable end for engaging the upper stretchable band; and FIG. 4B shows the loop closed around the broken-away upper stretchable band, showing the encased elastic material.

FIG. 5A is a perspective view of one end of the saddle bag shown in FIGS. 1 and 3, which helps to retain the towel, shown partially broken away, with a beverage container shown in dotted outline in two pockets of the saddle bag; and FIG. 5B is a perspective view of the two pockets of the saddle bag shown in FIG. 5A, taken from the outside of the pockets.

FIG. 6 is a perspective view of the saddle bag in the alternative embodiment of the invention shown in FIG. 3, in which the intermediate portion of the saddle bag is in the form of a band surrounding a mattress (not shown) on a beach chair, and with the intermediate portion of the band, its encased elastic material and the retained towel shown partially broken away, and with beverage containers shown in dotted outline in two pockets of the saddle bag.

In the various figures of the drawing like reference characters designate like parts.

Figure 3:
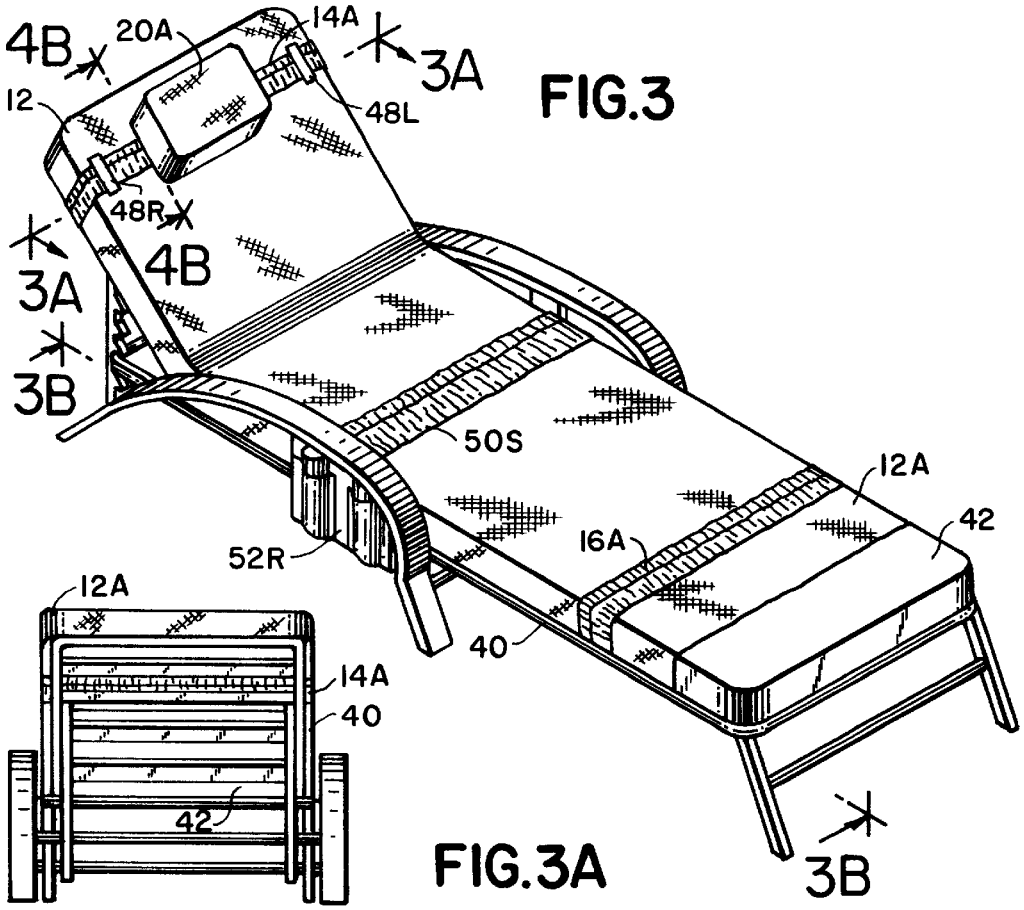
FIG. 3 (sheet 2) is a perspective view of a beach chair (of the pool chaise type) with a mattress covered by a beach towel held in place by upper and lower stretchable bands and an intermediate saddle bag, and also showing a pillow detachably attached to the upper stretchable band, which is held within longitudinal loops of the beach towel, all in accordance with an alternative embodiment of the invention.

DETAILED DESCRIPTIONS OF THE PREFERRED AND ALTERNATIVE EMBODIMENTS OF THE INVENTION

Referring to FIG. 1 (sheet 1) of the drawing, there is shown a beach chair 10 covered by a beach towel 12. An upper stretchable band 14 surrounds the upper portion of the beach chair 10 and the upper portion of the beach towel 12. A lower stretchable band 16 surrounds the lower portion of the beach chair 10 and the lower portion of the beach towel 12. A saddle bag 18 rests on the intermediate portion of the beach towel 12. Saddle bag 18 has pockets 20R and 20L (also see FIG. 1A) at each end of its intermediate strip 18S which hang respectively along the right and left sides of beach chair 10.

A pillow 20 is detachably attached to upper stretchable band 18, as is a pocket 22.

The pillow 20 (FIGS. 4A and 4B, sheet 3) consists of a pillow case 24 having an opening 26 which is coverable by flap 28, and an insertable pillow 30. The pillow case 24 is preferably made from terry cloth and the insertable pillow 30 from foam rubber. Flap 28 has a Velcro-hook fastener 32H sewed along its inner edge which matches a Velcro-loop fastener 32L sewed along the outside edge of the pillow case 28 framing the opening 26. When the Velcro-hook-loop fasteners 32 are pressed together the pillow case 24 fully encases the pillow 30.

A strap 34 has one end sewed to the pillow case 24 and its other inside end Velcro-hook fastener lined (not shown). Strap 34 is adapted to encircle the upper stretchable band 14 and attach to a matching Velcro-loop fastener (not shown) sewed to pillow case 24. In that way the pillow 20 is detachably attached to the upper stretchable band 14.

The upper stretchable band 14 (FIG. 4B) comprises an outer covering 14C, preferably made from terry cloth, which encases a stretchable band 14S, preferably made from elastic rubber. The outer covering 14C is an endless loop whose length is sufficient to bunch up when the stretchable band 14C is fully extended. The upper stretchable band 14 is shown separately in FIG. 2 (sheet 1). The lower stretchable band 16 (FIG. 1) is exactly the same, and interchangeable with, the upper stretchable band 14.

The pocket 22 (FIG. 1) is an open ended pocket, preferably made from terry cloth, which has a Velcro-hook fastener (not shown) sewed to its underside. The pocket 22 is detachably attached to the upper stretchable band 14 by engaging the hooks of the Velcro-hook fastener to the loops of the terry cloth of the upper stretchable band 14. Pocket 22 is especially useful for holding a small radio or audio cassette player and head phones.

The intermediate strip 18S of saddle bag 18 (FIGS. 1, 1B, 1C and 5A, 5B, sheet 3) is connected between the pockets 20R and 20L, preferably as one unitary piece of terry cloth. Alternatively, the pockets 2OR and 20L can be attached to the ends of intermediate strip 18S by Velcro-hook-loop fasteners. Since the width of each of the pockets 20R and 20L is larger than the width of the intermediate strip 18S, a stay 21 is positioned within a slot along the top of each of the pockets 20R and 20L to maintain each pocket in an extended longitudinal position.

Pocket 2OR comprises two separated receptacles 2OR1 and 20R2 (FIGS. 5A and 5B), each adapted to support a canned or bottled beverage, glasses, keys, sun tan lotion, reading material and other items which may be useful to the chair occupant. Pocket 20L is exactly the same as pocket 20R. A canned beverage is shown in dotted outline in receptacle 20R1. A folded magazine is shown extending from pocket 20L in FIGS. 1 and 1B.

The weight of each of the pockets 2OR and 20L when empty is sufficient to maintain the saddle bag 18 over the beach towel 12 when the chair 10 is unoccupied and a gust of wind occurs. The addition of items like a beverage or reading material in the pockets 20R and 20L increases the weight to retain the beach towel 12 in even a very high wind.

The beach towel 12 has a predetermined ornamental design (shown in part by cross hatching) and each of the towel material of the upper and lower stretchable bands 14 and 16, the saddle bag 18 and the pillow 20 preferably has the same or a coordinated ornamental design corresponding with the predetermined ornamental design of the beach towel 12. However, the stretchable bands 14 and 16 and the saddle bag 18 can be sold separately and for any towel.

Figure 3A:
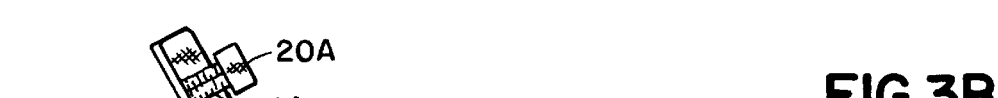
FIG. 3A is a back view of the upper portion of the beach chair of FIG. 3 taken along the lines 3A—3A in FIG. 3.
Figure 3B:
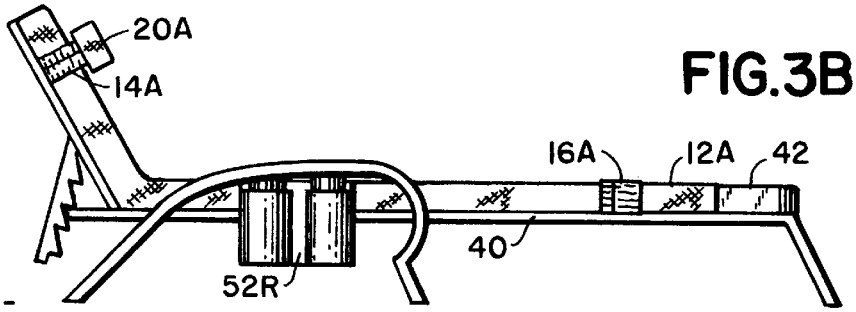
FIG. 3B is a side view of the beach chair of FIG. 3 taken along the lines 3B—3B in FIG. 3.
Figure 3C:
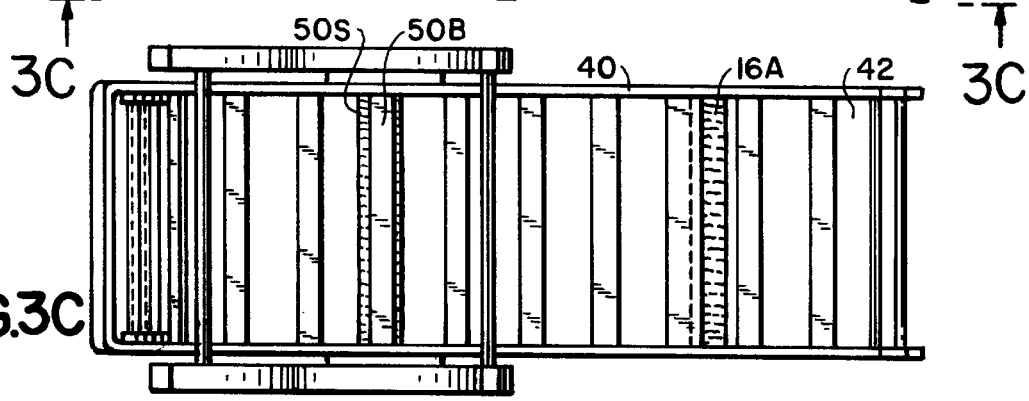
FIG. 3C is a bottom view of the beach chair of FIG. 3 taken along the lines 3C—3C in FIG. 3B.

An alternative embodiment of the beach towel retaining system invention is shown in FIGS. 3, 3A–3C (sheet 2) and FIG. 6 (sheet 3) for a beach (or pool chaise or lounge) chair 40 having a mattress 42. It differs mainly from the preferred embodiment shown in FIG. 1 in that the saddle bag 50 is in the form of a stretchable band 50S which encircles the mattress 42, and the beach towel 12A has longitudinal loops 48R and 48L on its right and left sides for receiving and retaining the upper stretchable band 14A.

The pillow 20A and the upper and lower stretchable bands 14A and 16A are the same as pillow 20 and upper and lower stretchable bands 14 and 16 in FIG. 1. The saddle bag 50 has pockets 52R and 52L attached respectively to the right and left ends of stretchable band 50S and otherwise are the same as pockets 2OR and 20L in FIG. 1. Pockets 52R and 52L are preferably attached to stretchable band 50S by Velcro-hook-loops fasteners, or they can be sewn to stretchable band 50S. Stretchable band 50S is preferably made from terry cloth and encircles an elastic band 50SE (FIG. 6) preferably made from rubber.

This alternative embodiment of the invention requires that the mattress 42 be lifted so that the stretchable band 50S of the saddle bag 50 can be stretched over the upper or lower end of mattress 42 and positioned over the intermediate portion of the mattress 42. The beach towel 12A is then inserted between the top surface of the mattress 42 and the lower surface of the stretchable band 50S. Then upper and lower stretchable bands 14A and 16A are positioned over the upper and lower portions of the beach towel 12A and upper and lower portions of the mattress 42.

It should be noted that the various Velcro-hoop-loop fasteners may be replaced by other attachment devices such as snaps, hooks and zippers.

Thus, in accordance with the invention, a beach towel retaining system has been provided accomplishing all of the objects, and having the features and advantages specified at the beginning of this specification.

It is to be understood that the disclosed construction of the invention may be embodied in other forms within the scope of the claims.

What is claimed is:

1. A towel retaining system for a beach chair having an upper portion for supporting the upper body of a chair occupant, an intermediate portion for supporting the intermediate body of the chair occupant and a lower portion for supporting the legs of the chair occupant comprising:

(A) a beach towel comprising a single layer free of a pocket at either end and having an upper portion for covering the upper portion of the beach chair, an intermediate portion for covering the intermediate portion of the beach chair and a lower portion for covering the lower portion of the beach chair;

(B) an upper stretchable band completely separate from said beach towel in the form of an endless open loop having a substantially constant width free of any material extending therefrom for solely and entirely and resiliently surrounding both the upper portion of said beach towel and the upper portion of the beach chair and engaging said beach towel for retaining the upper portion of said beach towel on the surface of the upper portion of the beach chair;

(C) a lower stretchable band completely separate from said beach towel in the form of an endless open loop having a substantially constant width free of any material extending therefrom for solely and entirely and resiliently surrounding both the lower portion of said beach towel and the lower portion of the beach chair and engaging said beach towel for retaining the lower portion of said beach towel on the surface of the lower portion of the beach chair; and (D) a saddle bag completely separate from said beach towel comprising a strip with a pocket at each end, said strip resting on top of the intermediate portion of said beach towel such that one of said pockets hangs on one side of the intermediate portion of the beach chair and the other of said pockets hangs on the other side of the intermediate portion of the beach chair, to retain the intermediate portion of said beach towel on the intermediate portion of the beach chair.

2. A towel retaining system according to claim 1 wherein each of said upper and lower stretchable bands comprises an open loop of solely elastic material with said towel material separately and entirely encasing said elastic material along its entire length.

3. A towel retaining system according to claim 1 further comprising a pillow adapted to be detachably attached to the outer surface of said upper stretchable band.

4. A towel retaining system according to claim 1 further comprising a pillow adapted to be detachably attached to the outer surface of said upper stretchable band, said pillow comprising a towel material encasing a compressible material.

5. A towel retaining system according to claim 1 wherein said pocket on one of said ends of said strip of said saddle bag is one of a plurality of pockets on that end.

6. A towel retaining system according to claim 1 wherein said upper portion of said beach towel has an attached longitudinal loop adjacent each side adapted to receive and retain said upper stretchable band.

7. A towel retaining system according to claim 6 wherein each of said attached longitudinal loops has one end permanently attached to said beach towel and the other end detachably attached to said beach towel.

8. A towel retaining system according to claim 1 wherein said beach chair has a mattress and said strip comprises a stretchable band for resiliently surrounding both said intermediate portion of said beach towel and the mattress.

9. A towel retaining system according to claim 8 wherein said stretchable band of said strip comprises a towel material separately encasing an elastic material.

10. A towel retaining system according to claim 1 wherein said beach towel has a predetermined ornamental design and each of said upper and lower stretchable bands has a corresponding ornamental design as said predetermined ornamental design.

11. A towel retaining system according to claim 9 wherein said beach towel has a predetermined ornamental design and each of said upper and lower stretchable bands and said strip of said saddle bag has a corresponding ornamental design as said predetermined ornamental design.

12. A towel retaining system according to claim 4 wherein said beach towel has a predetermined ornamental design and each of the towel material of said upper and lower stretchable bands, said saddle bag and said pillow has a corresponding ornamental design as said predetermined ornamental design.

13. A towel retaining system for a beach chair having an upper portion for supporting the upper body of a chair occupant, an intermediate portion for supporting the intermediate body of the chair occupant and a lower portion for supporting the legs of the chair occupant comprising:

(A) a beach towel comprising a single layer free of a pocket at either end and having an upper portion for covering the upper portion of the beach chair, an intermediate portion for covering the intermediate portion of the beach chair and a lower portion for covering the lower portion of the beach chair;

(B) an upper stretchable band completely separate from said beach towel in the form of an endless open loop having a substantially constant width for solely and entirely and resiliently surrounding both the upper portion of said beach towel and the upper portion of the beach chair and engaging said beach towel for retaining the upper portion of said beach towel on the surface of the upper portion of the beach chair; and (C) a lower stretchable band completely separate from said beach towel in the form of an endless open loop having a substantially constant width for solely and entirely and resiliently surrounding both the lower portion of said beach towel and the lower portion of the beach chair and engaging said beach towel for retaining the lower portion of said beach towel on the surface of the lower portion of the beach chair.

14. A towel retaining system according to claim 13 wherein each of said upper and lower stretchable bands comprises an open loop of solely elastic material with towel material separately and entirely encasing said elastic material along its entire length.

15. A towel retaining system according to claim 13 further comprising a pillow adapted to be detachably attached to the outer surface of said upper stretchable band.

16. A towel retaining system according to claim 14 further comprising a pillow adapted to be detachably attached to the outer surface of said upper stretchable band, said pillow comprising a towel material encasing a compressible material.

17. A towel retaining system according to claim 14 wherein said beach towel has a predetermined ornamental design and the towel material of each of said upper and lower stretchable bands has a corresponding ornamental design as said predetermined ornamental design.

18. A towel retaining system for a beach chair having an upper portion for supporting the upper body of a chair occupant, an intermediate portion for supporting the intermediate body of the chair occupant and a lower portion for supporting the legs of the chair occupant comprising:

(A) a beach towel having an upper portion for covering the upper portion of the beach chair, an intermediate portion for covering the intermediate portion of the beach chair and a lower portion for covering the lower portion of the beach chair;

(B) an upper stretchable band completely separate from said beach towel for resiliently surrounding both the upper portion of said beach towel and the upper portion of the beach chair and for retaining the upper portion of said beach towel on the surface of the upper portion of the beach chair;

(C) a lower stretchable band completely separate from said beach towel for resiliently surrounding both the lower portion of said beach towel and the lower portion of the beach chair and for retaining the lower portion of said beach towel on the surface of the lower portion of the beach chair;

(D) wherein each of said upper and lower stretchable bands comprises a towel material separately encasing an elastic material, and (E) wherein said towel material is terry cloth and further comprises a Velcro-hook attachable pocket for attachment to the loops of the terry cloth.

19. A towel retaining system according to claim 13 wherein said beach towel has a predetermined ornamental design and the towel material of each of said upper and lower stretchable bands has a corresponding ornamental design as said predetermined ornamental design.

20. A towel retaining system for a beach chair having an upper portion for supporting the upper body of a chair occupant, an intermediate portion for supporting the intermediate body of the chair occupant and a lower portion for supporting the legs of the chair occupant, with a beach towel comprising a single layer free of a pocket at either end and having an upper portion for covering the upper portion of the beach chair, an intermediate portion for covering the intermediate portion of the beach chair and a lower portion for covering the lower portion of the beach chair, comprising:

(A) an upper stretchable band completely separate from said beach towel in the form of an endless open loop having a substantially constant width for solely and entirely and resiliently surrounding both the upper portion of the beach towel covering the upper portion of the beach chair and the upper portion of the beach chair and engaging said beach towel for retaining the upper portion of the beach towel on the surface of the upper portion of the beach chair; and (B) a lower stretchable band completely separate from said beach towel in the form of an endless open loop having a substantially constant width for solely and entirely and resiliently surrounding both the lower portion of the beach towel and the lower portion of the beach chair and engaging said beach towel for retaining the lower portion of the beach towel on the surface of the lower portion of the beach chair.

* * * * *